US007412802B2

(12) United States Patent
Kantor

(10) Patent No.: US 7,412,802 B2
(45) Date of Patent: Aug. 19, 2008

(54) SWIMMING POOL FORMED OF INTERCONNECTING PANELS WITH SUPPORTING BUTTRESSES

(75) Inventor: Paul Kantor, South Haven, MI (US)

(73) Assignee: Caravelle International, Inc., Schuykill Haven, PA (US)

( * ) Notice: Subject to any disclaimer, the term of this patent is extended or adjusted under 35 U.S.C. 154(b) by 458 days.

(21) Appl. No.: 10/982,010

(22) Filed: Nov. 5, 2004

(65) Prior Publication Data

US 2005/0091934 A1 May 5, 2005

Related U.S. Application Data

(60) Provisional application No. 60/517,509, filed on Nov. 5, 2003, provisional application No. 60/533,184, filed on Dec. 30, 2003.

(51) Int. Cl.
*E04H 4/02* (2006.01)
*E04B 1/38* (2006.01)

(52) U.S. Cl. ..... 52/169.8; 52/584.1; 249/DIG. 3

(58) Field of Classification Search ..... 52/169.7, 52/169.8, 584.1; 4/513; 249/DIG. 3, 196
See application file for complete search history.

(56) References Cited

U.S. PATENT DOCUMENTS

| | | | | |
|---|---|---|---|---|
| 2,197,318 | A | 4/1940 | Rumble | |
| 2,488,708 | A | 11/1949 | Clemetsen | |
| 2,829,081 | A | 4/1958 | Sweem | |
| 3,015,191 | A | 1/1962 | Lucchesi | |
| 3,020,560 | A | 2/1962 | Bedick | |
| 3,064,273 | A | 11/1962 | Kwake | |
| 3,094,709 | A | 6/1963 | Miccio et al. | |
| 3,123,185 | A * | 3/1964 | Van Der Rijst | 52/633 |
| 3,440,780 | A | 4/1969 | Adam et al. | |
| 3,750,197 | A | 8/1973 | Weir et al. | |
| 3,798,857 | A | 3/1974 | Barrera | |

(Continued)

FOREIGN PATENT DOCUMENTS

FR 1307721 10/1962

(Continued)

OTHER PUBLICATIONS

"Revitalize" brochure, published Feb. 1993 by Paul Kantor.

(Continued)

*Primary Examiner*—M. Safavi
(74) *Attorney, Agent, or Firm*—Price, Heneveld, Cooper, Dewitt & Litton, LLP

(57) ABSTRACT

A wall and buttress construction for swimming pools in which deck support extensions can be secured to the top of the buttresses. The wall includes a plurality of panels having end flanges at the sides of the panels, and a double slotted peg is provided. One of the slots is shorter to receive a wedge when a peg is placed through two abutting panel end flanges, and the other slot being longer to accommodate a wedge when the peg is being used to join a brace as well as two abutting end flanges. The end flanges have elongated openings therethrough for receiving the pegs that are oriented diagonally, rather than either vertically or horizontally. The elongated openings, pegs and wedges are easily visible/accessible for inserting pegs as a result of the diagonal orientation.

20 Claims, 12 Drawing Sheets

U.S. PATENT DOCUMENTS

| | | | | | |
|---|---|---|---|---|---|
| 3,820,174 | A | | 6/1974 | Rozanski | |
| 3,974,605 | A | | 8/1976 | Beatty et al. | |
| 3,975,874 | A | * | 8/1976 | Witte et al. | 52/169.7 |
| 4,077,173 | A | * | 3/1978 | Rozanski | 52/169.8 |
| 4,124,907 | A | | 11/1978 | Laven | |
| 4,203,170 | A | | 5/1980 | Lankheet | |
| 4,205,499 | A | * | 6/1980 | Lankheet | 52/169.7 |
| 4,333,186 | A | | 6/1982 | Lankheet | |
| 4,343,118 | A | * | 8/1982 | Lankheet | 52/169.7 |
| 4,464,802 | A | | 8/1984 | Glonek et al. | |
| 4,548,005 | A | | 10/1985 | Glonek et al. | |
| 4,566,141 | A | | 1/1986 | Mahoney | |
| 4,577,449 | A | | 3/1986 | Celli | |
| RE32,181 | E | | 6/1986 | Glonek et al. | |
| 4,671,028 | A | | 6/1987 | Figone | |
| 4,679,763 | A | | 7/1987 | Brotherton | |
| 4,695,033 | A | * | 9/1987 | Imaeda et al. | 249/192 |
| 4,915,345 | A | | 4/1990 | Lehmann | |
| 5,018,324 | A | | 5/1991 | Lankheet | |
| 5,025,601 | A | * | 6/1991 | Hand | 52/169.7 |
| 5,137,251 | A | | 8/1992 | Jennings | |
| 5,231,807 | A | * | 8/1993 | Aymes | 52/169.8 |
| 5,277,004 | A | | 1/1994 | Frei | |
| 5,400,555 | A | | 3/1995 | Kantor | |
| 5,590,493 | A | | 1/1997 | Wilson | |
| 6,283,439 | B1 | * | 9/2001 | Myers et al. | 249/196 |

FOREIGN PATENT DOCUMENTS

| | | |
|---|---|---|
| FR | 1319772 | 3/1963 |
| GB | 895458 | 5/1962 |
| NL | 0100687 | 3/1962 |

OTHER PUBLICATIONS

"Have You Thought About it?" brochure, published De. 1992 by Paul Kantor.

Middle-Garden Swimming Pool Construction Guide, published Jul. 1992 by William P. Kantor.

* cited by examiner

SWIMMING POOL FORMED OF INTERCONNECTING PANELS WITH SUPPORTING BUTTRESSES

CROSS-REFERENCE TO RELATED APPLICATIONS

The present application claims the benefit of U.S. Provisional Patent Application No. 60/517,509, entitled "POOL," which was filed Nov. 5, 2003, and U.S. Provisional Patent Application No. 60/533,184, entitled "POOL," which was filed Dec. 30, 2003, the entire contents of each of which are hereby incorporated herein by reference.

BACKGROUND OF THE INVENTION

The present invention relates to pools, especially larger pools typically referred to as swimming pools. However, the invention could be used to produce so-called swim spas, wading pools or the like.

SUMMARY OF THE INVENTION

The present invention comprises a wall and buttress construction for swimming pools in which deck support extensions can be secured to the top of the buttresses.

In another aspect of the invention, the wall includes a plurality of panels having end flanges at the sides of the panels, and a double slotted peg is provided. One of the slots is shorter to receive a wedge when a peg is placed through two abutting panel end flanges, and the other slot being longer to accommodate a wedge when the peg is being used to join a brace as well as two abutting end flanges.

Preferably the end flanges have elongated openings therethrough for receiving the pegs that are oriented diagonally, rather than either vertically or horizontally. They are much more easily visible/accessible for inserting pegs as a result of the diagonal orientation.

In another aspect of the invention, the wall panels themselves are reinforced with intersecting parabolic arches on the back surfaces thereof. In yet another aspect of the invention, the buttresses are provided with a plurality of plumbing saddles for receiving plumbing lines to plumb the swimming pool. In addition, the buttresses also preferably have oversized rebar holes, approximately three times the diameter of rebar, to make it easier to slide long lengths of rebar into the buttresses to facilitate anchoring the walls in the ground or in concrete footings.

These and other aspects, features and advantages of the invention will be more fully understood and appreciated by reference to the written specification and appended drawings.

DETAILED DESCRIPTION OF THE PREFERRED EMBODIMENT

Figure 1:
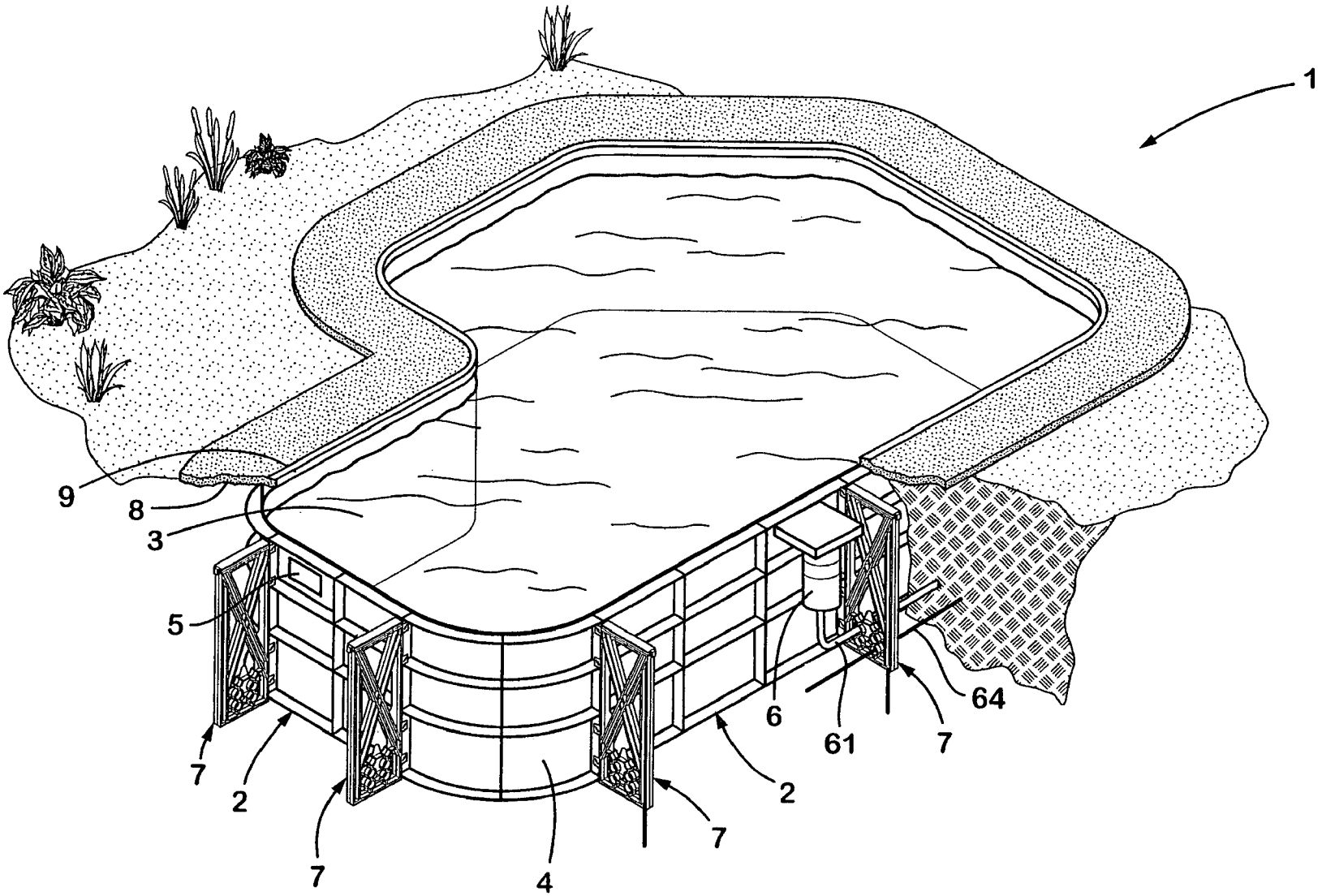
FIG. 1 is a partially fragmentary perspective view of a pool according to one aspect of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
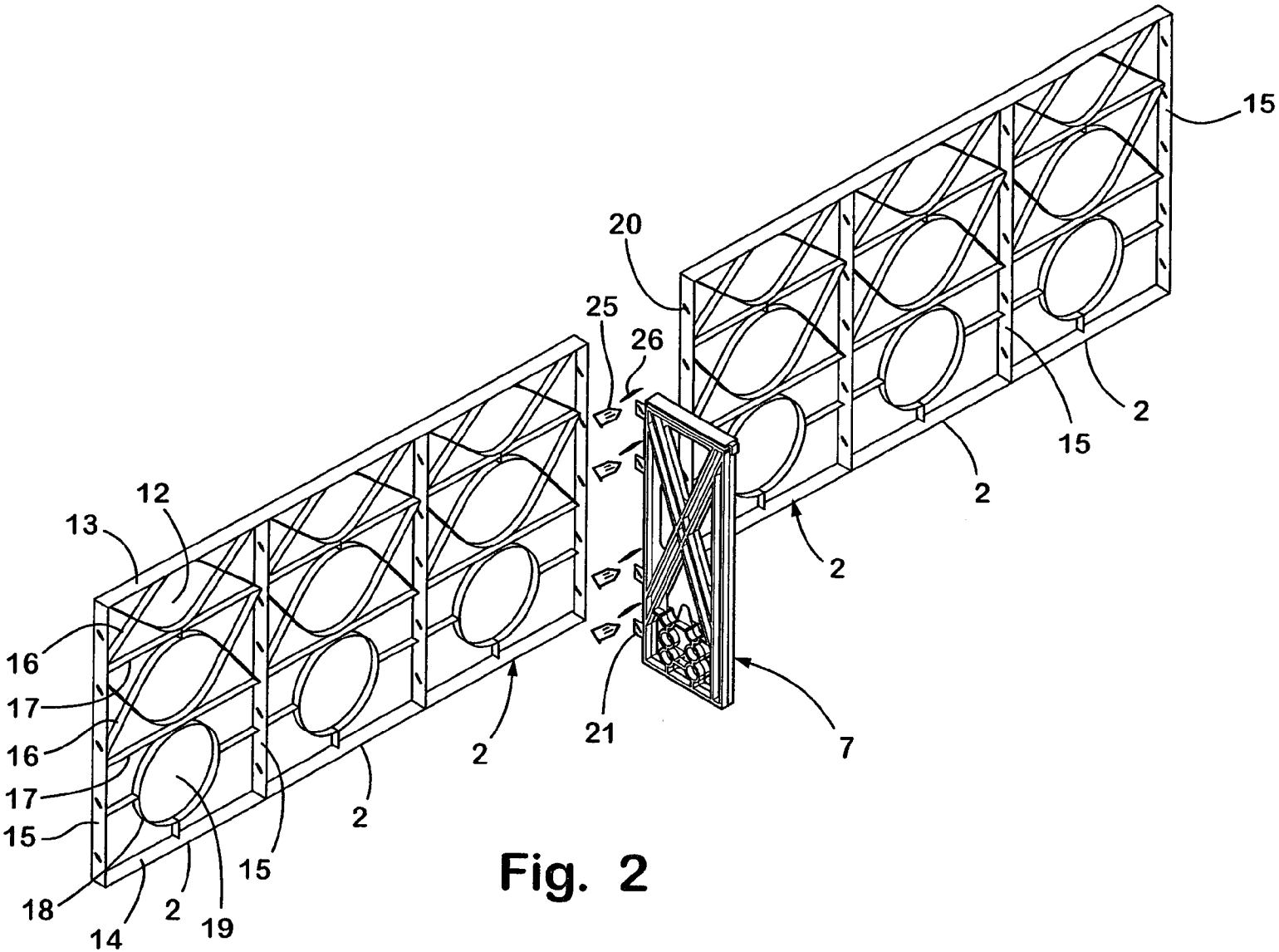
FIG. 2 is an exploded perspective view of a portion of the pool of FIG. 1.

With reference to FIG. 1, pool 1 includes a plurality of panels 2 forming a wall 10 and a liner 3. As described in more detail below, adjacent panels 2 can be quickly and easily interconnected utilizing pegs 25 and wedges 26 to form a strong and durable structure. The panels may be curved panels 4 having a relatively large or small radius, forming inside or outside corners. The panels 2 may include a cutout 5 that can be removed for installing a skimmer 6. One or more buttresses 7 may be interconnected to the panels 2 to provide additional support. Also, a concrete deck 8 extends around the pool, and is supported by the buttresses 7 as described in more detail below. With reference to FIG. 2, each panel 2 includes a wall 12, an upper flange 13, lower flange 14, and vertically extending side flanges 15. Parabolic ribs 16 and horizontal ribs 17 extend across the wall 12 to provide structural support. A circular rib 18 extends around a cutout 19 for mounting of a light (not shown). The panels 2 and buttress 7 are made of a polymer material having a tough outer skin and inner cellular structure providing a very strong and durable pool structure. Conventional coping 9 extends around the top edge of wall 10 and overlaps the joints formed at adjacent panels 2 to thereby reinforce the wall structure and align adjacent panels 2. As also discussed in more detail below, coping 9 secures the upper edge 11 (FIG. 10A) of the pool liners to the panels 2.

Figure 3:
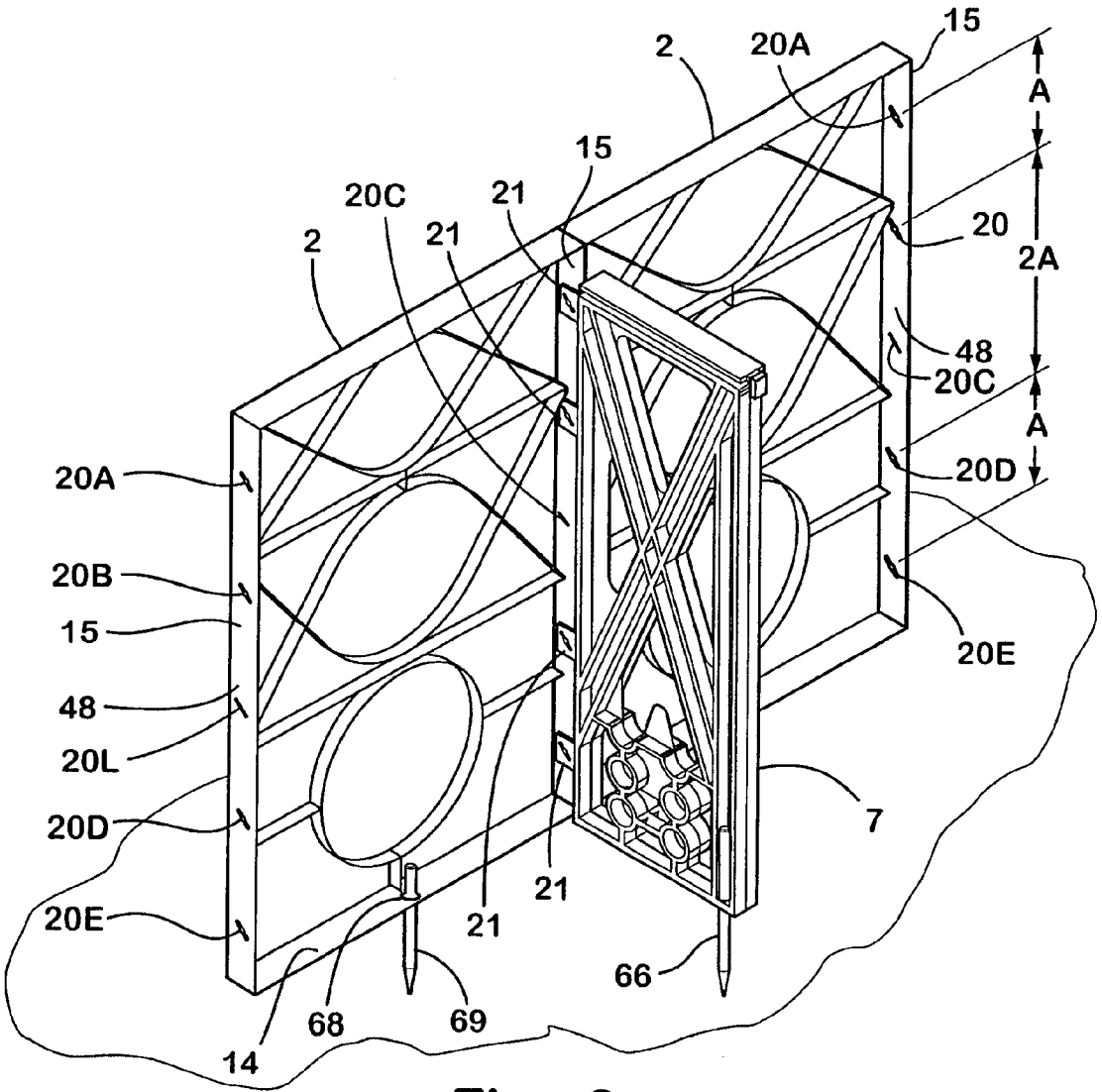
FIG. 3 is a perspective view of a portion of the pool of FIG. 1.
Figure 4:
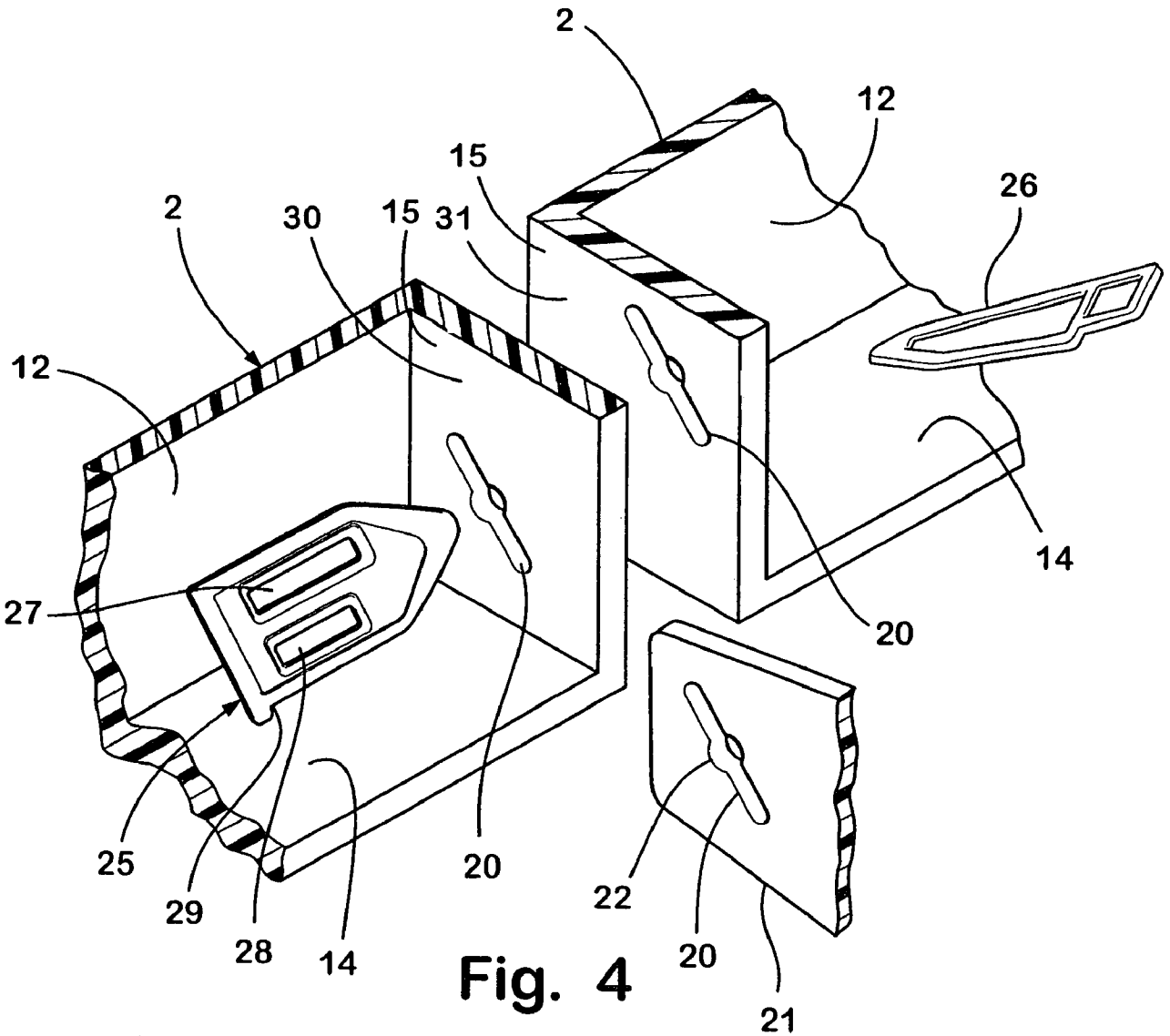
FIG. 4 is a fragmentary, perspective view of a peg and wedge that may be utilized to interconnect adjacent panels of the pool.

Each side flange 15 includes a plurality of openings 20 therethrough (see also FIGS. 3 and 4), and each buttress 7 includes a plurality of tabs or extensions 21. Each tab 21 also has an opening 20 therethrough having the same shape, size, and orientation as openings 20 in flanges 15 of panels 2. Openings 20 are in the form of an elongated slot having an enlarged center portion 20. Slots 20 are preferably oriented at about a 45° angle relative to the vertical walls 12 of panels 2. Pegs 25 extend through openings 20, and a wedge 26 extends through a selected one of the openings 27 and 28 in wedge 25 to securely and tightly interconnect adjacent panels 2. Alternately, conventional threaded nylon fasteners (not shown) may be inserted through the enlarged center portion 22 of openings 20 to interconnect the adjacent panels 2.

If a pair of adjacent panels 2 are directly interconnected without a buttress 7, the peg 25 is inserted through the openings 20 of the adjacent side flanges 15 of the panels 2, until extension 29 contacts sidewall surface 30 (FIG. 4) of side flange 15. Wedge 26 is then inserted through the shorter opening 28 to interconnect the adjacent panels 2. If a buttress 7 is to be interconnected to the panels 2, the tabs 21 of the buttresses 7 are positioned adjacent the side surface 30 with the opening 20 of tab 21 in alignment with the openings 20 of the side flanges of the panels 2. The peg 25 is then inserted through the openings 20 in the tabs 21 and side flanges 15, and wedge 26 is inserted into the longer slot 27 in peg 25. Thus, the different lengths of the slots 27 and 28 permit the peg 25 to be utilized for interconnecting adjacent panels 2 either with or without a buttress 7. The side surface 31 of vertical flanges 15 of panels 2 are substantially smooth and uninterrupted, such that adjacent surfaces 31 abut one another when adjacent panels 2 are interconnected. The peg 25 and wedge 26 provide alignment for adjacent panels, such that additional alignment features are not required.

Figure 6:
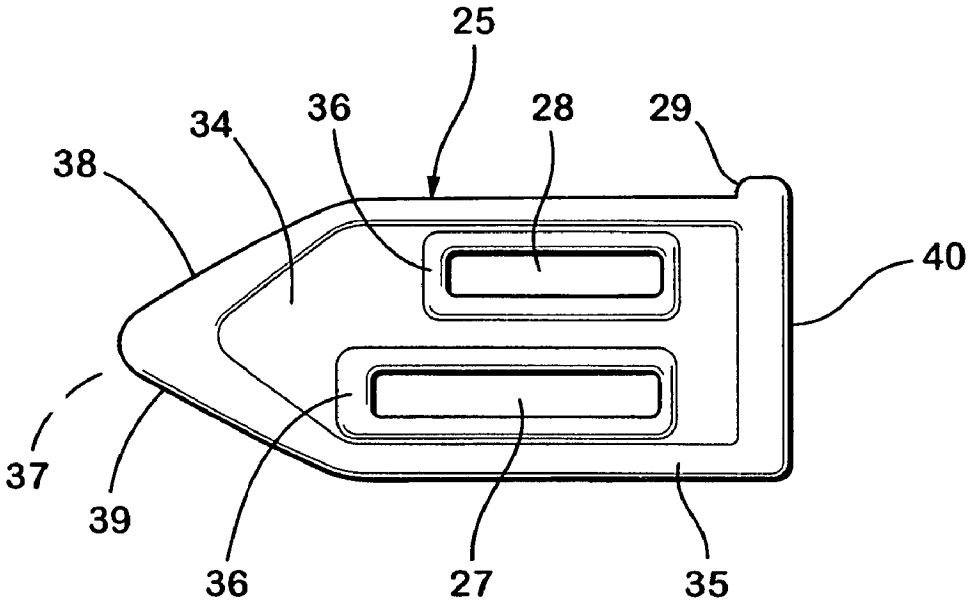
FIG. 6 is a plan view of the peg.

With further reference to FIG. 6, peg 25 includes a central web portion 34 and a smoothly radiused thicker edge portion 35 that extends around the peg 25 to provide additional strength. Similarly, thicker radiused portions 36 extend around openings 28 to provide additional strength. Tapered surfaces 38 and 39 form a pointed end portion 37 of peg 25. The tapered edges 38 and 39 facilitate insertion of the peg 25 in openings 20, and also bring adjacent openings 20 into alignment during assembly. An end or head 40 distributes forces if a hammer or the like is used to tap or drive the peg 25 into openings 20.

Figure 5:
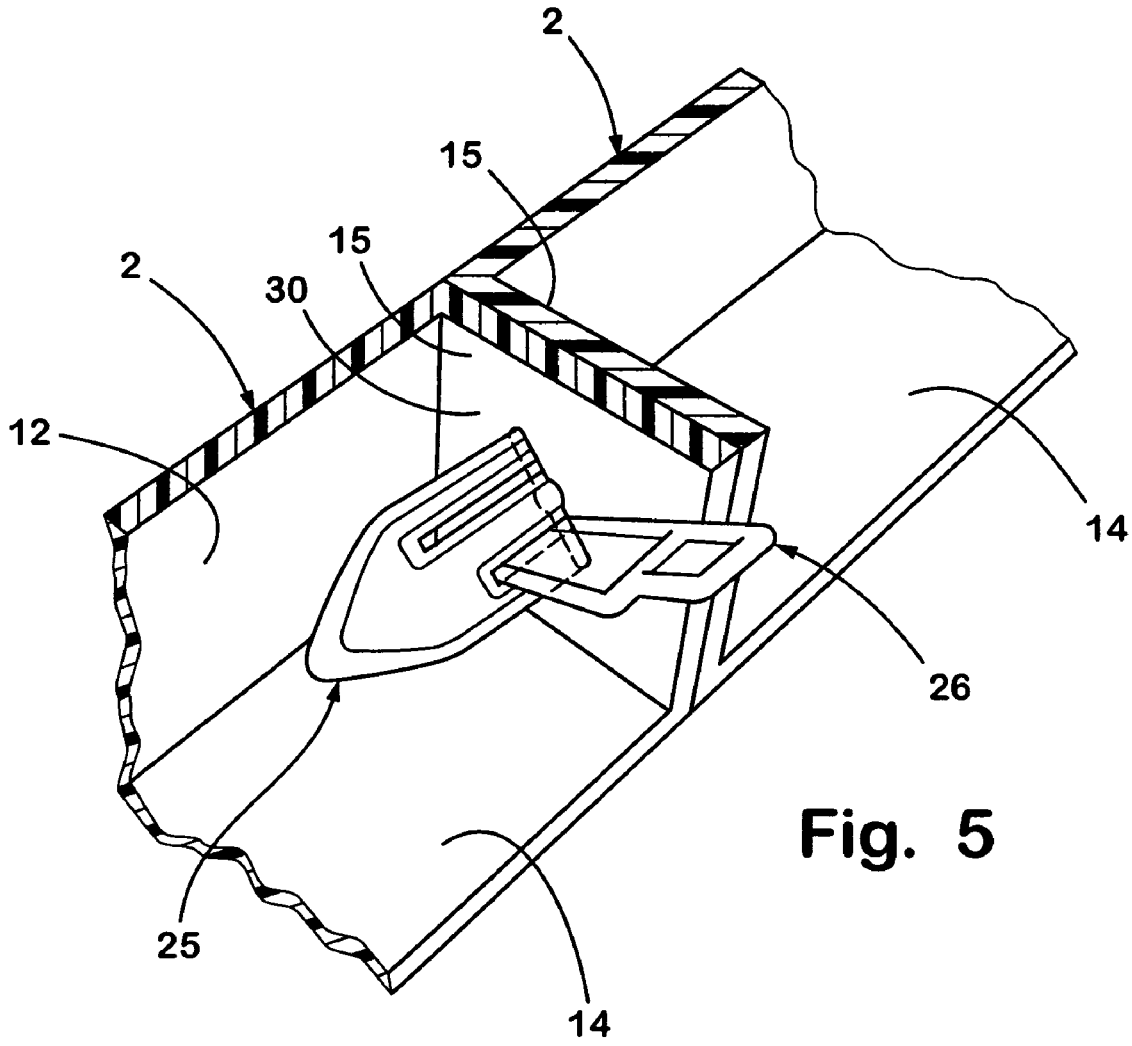
FIG. 5 is a fragmentary view showing the peg and wedge in the assembled condition.
Figure 7:
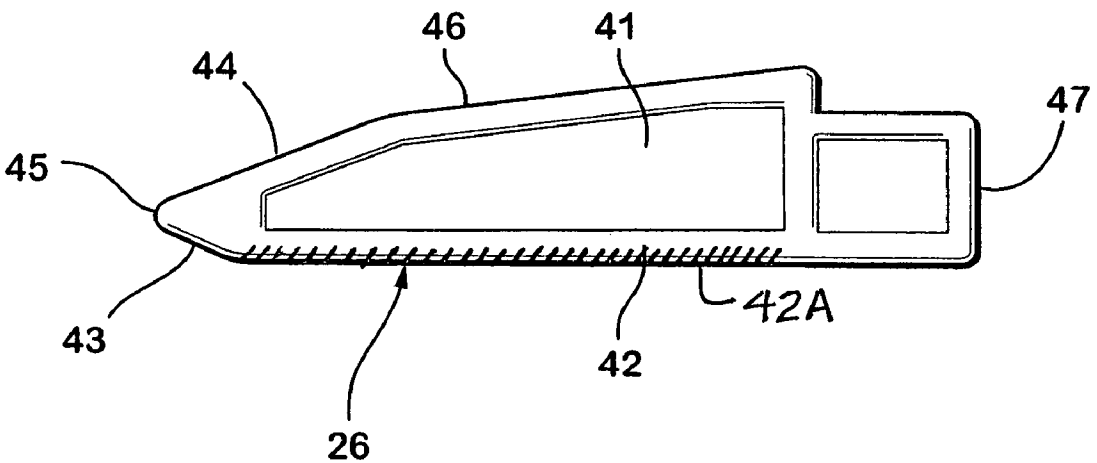
FIG. 7 is a plan view of the wedge.

With further reference to FIG. 7, wedge 26 includes a central web portion 41 and thicker, radiused edge portions 42 that provide additional strength. End 45 of wedge 26 includes a first tapered edge 43 and second tapered edge 44. Edge portion 46 is tapered less than edge portion 44, and provides a tight wedging action when wedge 26 is inserted into opening 27 or 28 of peg 25. End or head 47 provides for distribution of forces if a hammer or the like is utilized to securely drive the wedge 26 into the opening 27 or 28 of peg 25. Tapered edges 43 and 44 at end 45 facilitate insertion of wedge 26 and further contribute to quick and easy assembly of pool 1. Edge 42A may be serrated to provide a secure, high friction engagement with openings 27, 28 of peg 25 to ensure that wedge 26 does not become dislodged. Wedge 26 is preferably inserted into slot 27 or 28 in peg 25 in the orientation shown in FIG. 4, such that edge 46 contacts surface 30 of flange 15. Alternately, wedge 26 may be installed in an orientation as illustrated in FIG. 5, wherein serrated edge 42A contacts surface 30 of flange 15. The peg 25 and wedge 26 are made of a polycarbonate material that provides sufficient strength to structurally interconnect adjacent panels 2 and buttress 7, and also provides impact resistance to prevent cracking during installation.

The peg 25 and wedge 26 provide for very quick and secure interconnection of adjacent panels 2 and buttresses 7. Also, the angle of opening 20 ensures that the peg 25 and wedge 26 can be easily seen by the builder even if there is limited space between the wall 10 and the adjacent earth. Also, the wedge 26 tightly draws the adjacent panels 2 together. Side flanges 15 may be provided with five openings 20 including upper openings 20A and 20B (FIG. 3), a central opening 20C, and lower openings 20D and 20E. The upper and lower pairs of openings are spaced apart a distance "A", and openings 20B and 20D are spaced a distance that is twice as great ("2A"). Tabs 21 of buttress 7 are also spaced such that openings 20 through tabs 21 of buttress 7 align with the openings 20A, 20B, 20D and 20E in side flanges 15 of panels 2.

During assembly, a pair of adjacent panels 2 are positioned side-by-side, and a peg 25 is inserted through central openings 206 of the adjacent panels 2. A wedge 26 is then inserted through smaller opening 28 of peg 25. After the panels are interconnected at central openings 206, a buttress 7 is positioned with tabs 21 adjacent a side flange 15 of one of the panels 2, with opening 20 through tab 21 aligned with openings 20 of panels 2. Pegs 25 are then inserted through openings 20 in tab 21 and flanges 15, and a wedge 26 is then inserted in larger opening 27 to thereby interconnect the panels 2 and buttress 7.

Figure 8:
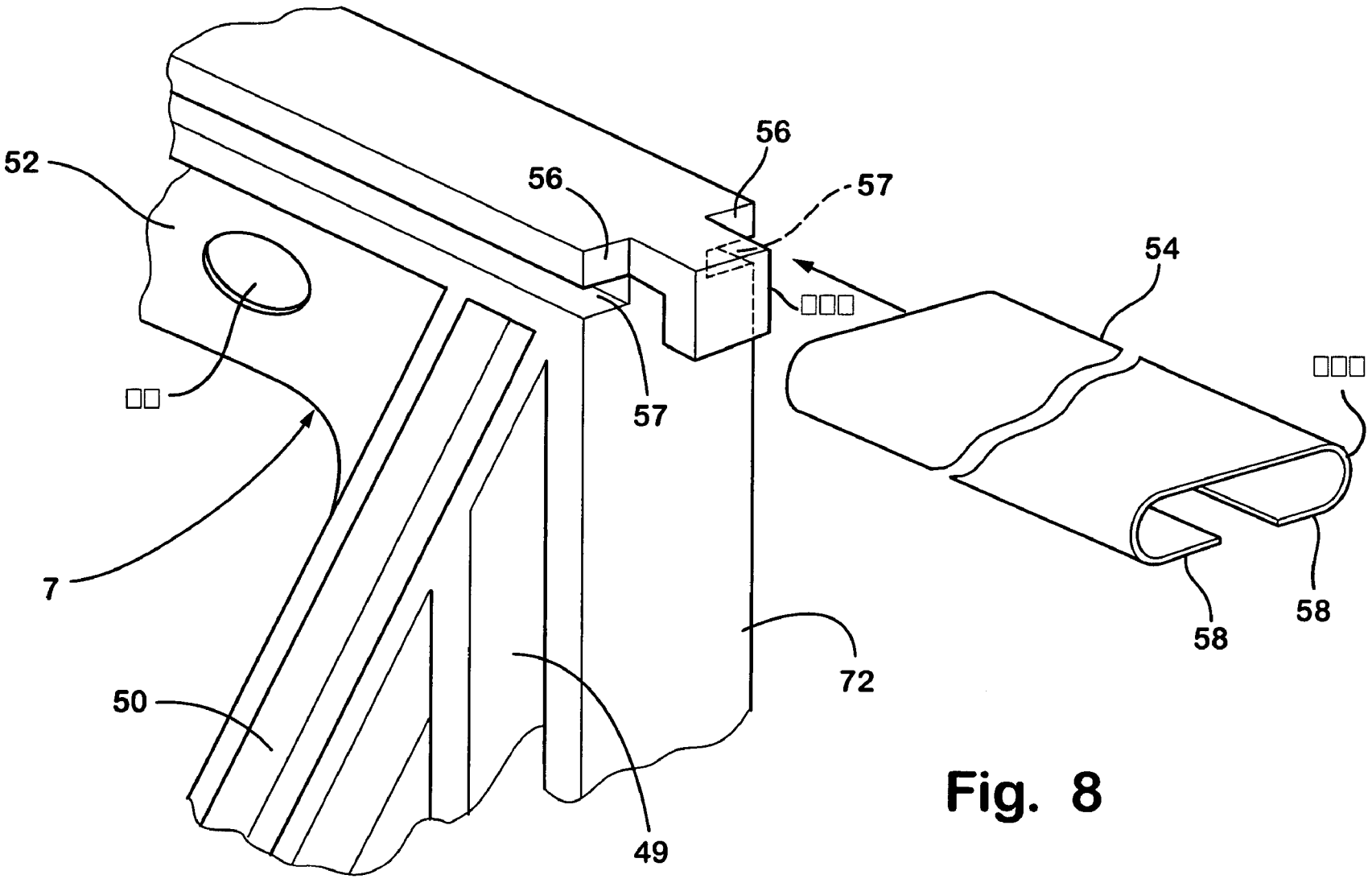
FIG. 8 is a partially fragmentary, perspective view of a deck support extension.
Figure 10:
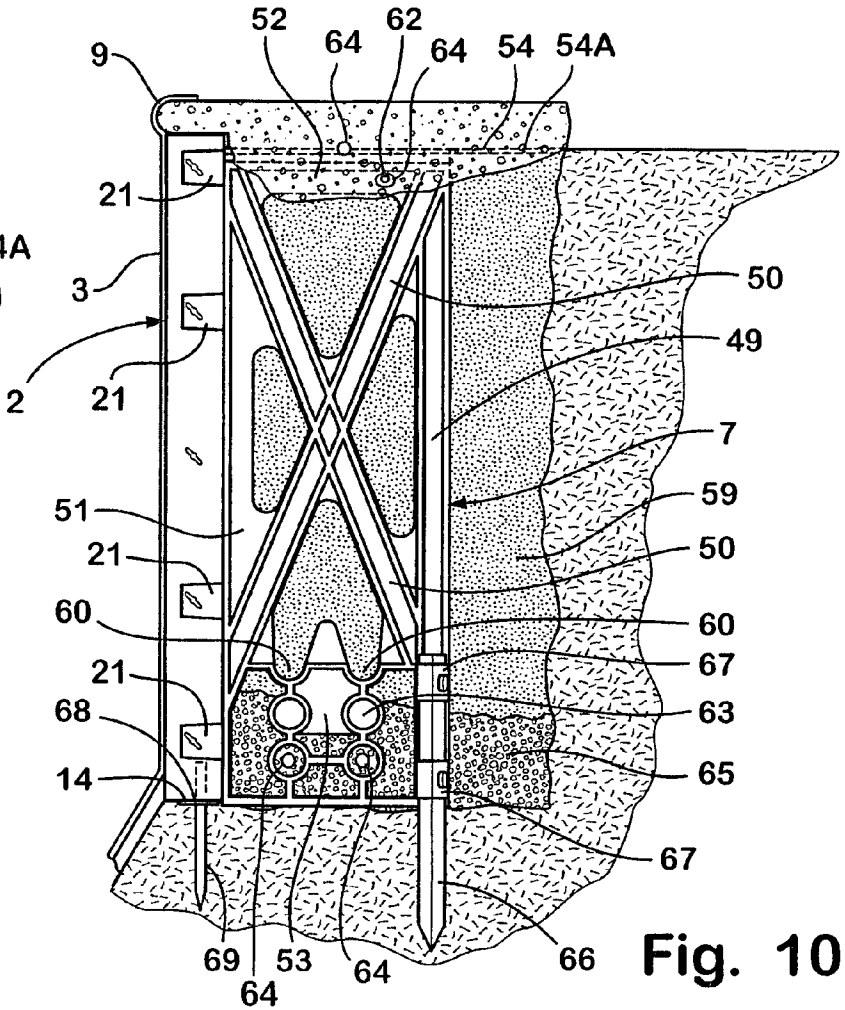
FIG. 10 is a side view of a buttress and deck extension.
Figure 9:
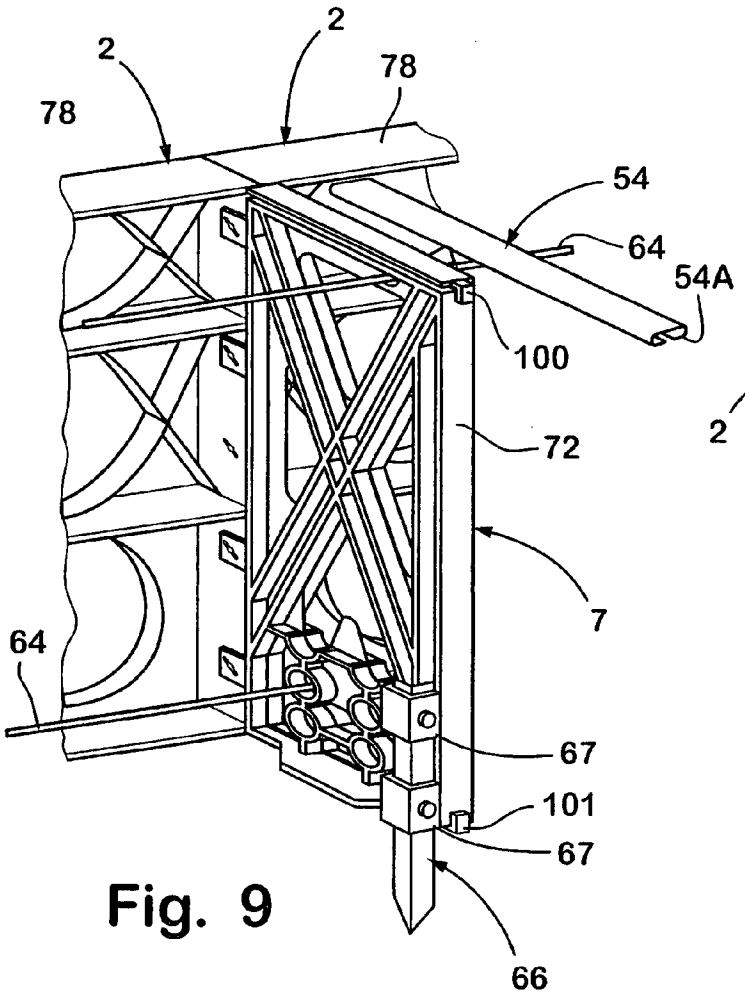
FIG. 9 is a fragmentary, perspective view of a buttress and deck support.

With further reference to FIGS. 8-10, buttresses 7 include an outer vertical structural portion 49, an inner vertical portion 51, and inner structural portions 50 that extend at angles to form a structurally strong and rigid "X" configuration. As described in more detail below, upper horizontal structure 52 may provide support for a concrete deck 8, and lower structure 53 provides for routing of plumbing. Upper portion of buttress 7 includes a pair of horizontally extending horizontal flanges 56 (FIG. 8) forming a pair of horizontal slots 57 on opposite sides of buttress 7. A deck support extension 54 has a generally flat C-shaped cross section. During assembly, extension 54 slides onto buttress 7 with end portions or flanges 58 of extension 54 received in slots 57. Extension 54 is made of steel or other suitable material providing strength and durability. The deck support extension permits the concrete that is used to form deck 8 to be poured prior to compaction of soil 59 to provide for rapid construction of the pool. Buttresses 7 are preferably about 14 inches wide, and flanges 15 of panels 2 are about 4 inches wide. Extension 54 is about 30 inches long, such that a standard concrete deck 8 extends about 2 inches beyond end 54A (see also FIG. 10) of extension 54. The concrete material preferably extends downwardly around extension 54 and an upper part of buttress 7.

Figure 10A:
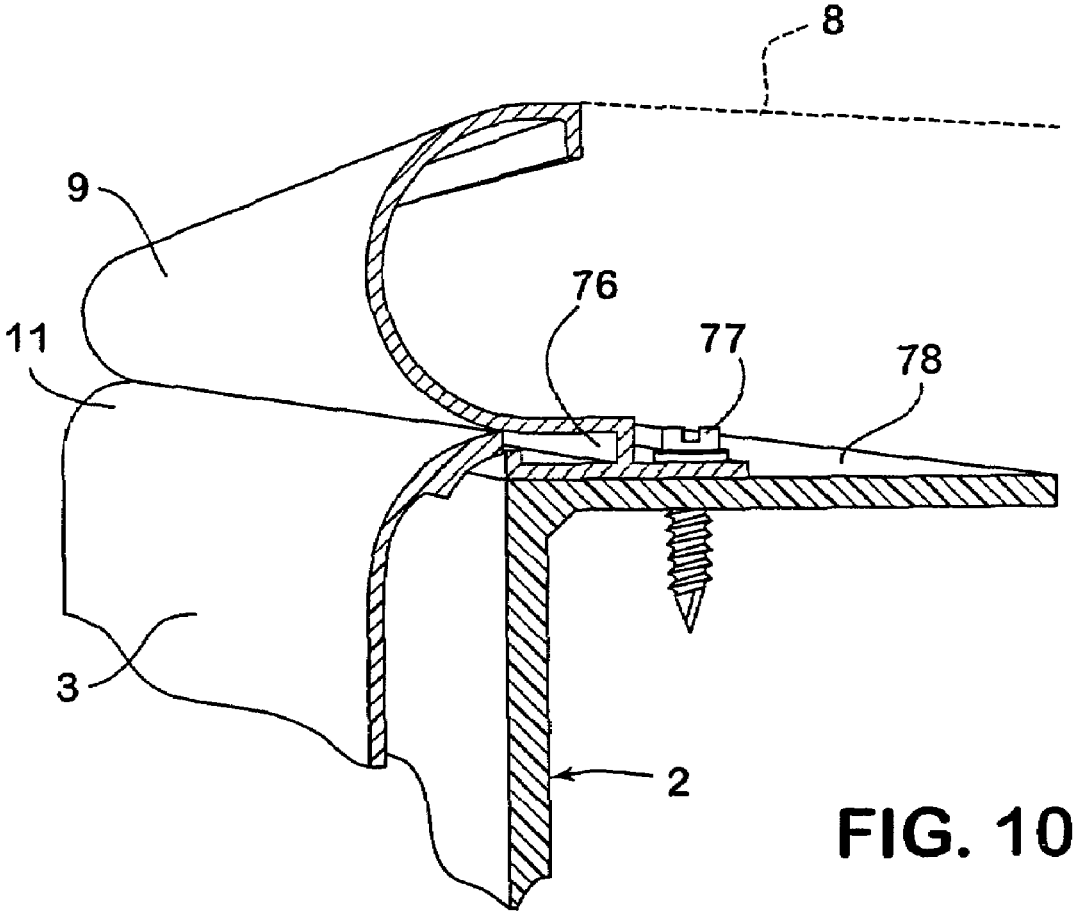
FIG. 10A is a fragmentary cross-sectional view of an upper portion of the pool wall.

With reference to FIG. 10, lower structure 53 of buttress 7 includes at least two plumbing cradles 60 that support pipes 61 (see also FIG. 1) for skimmer 6, filters and/or other such components. As illustrated in FIG. 13, buttress 7 may include three plumbing cradles 60 to support additional pipes or other lines. Rebar 64 (see also FIGS. 11 and 12) may extend through openings 62 and/or openings 63 in buttress 7 to provide additional structural support. The rebar 64 may also extend through a concrete footing 65 (FIG. 10) to provide additional structural reinforcement. The lower portions of buttresses 7 are embedded in footing 65 to anchor and support the pool structure. A pair of extensions 67 slidably receive and retain a stake 66 that further secures and anchors the buttress 7. Openings 68 (see also FIG. 3) in lower flange 14 of panels 2 receive a stake 69 that may be made from rebar to further anchor the panels 2. As illustrated in FIG. 10A, coping 9 includes a channel that receives an enlarged, barbed edge 11 of lining 3 to thereby secure the liner 3 to the panels 2. Self-tapping screws 77 attach coping 9 to upper flanges 78 of panel 2. Coping 9 also provides a form/support for concrete deck 8. Coping 9 is preferably made of a rigid corrosion resistant material such as aluminum.

Figure 11:
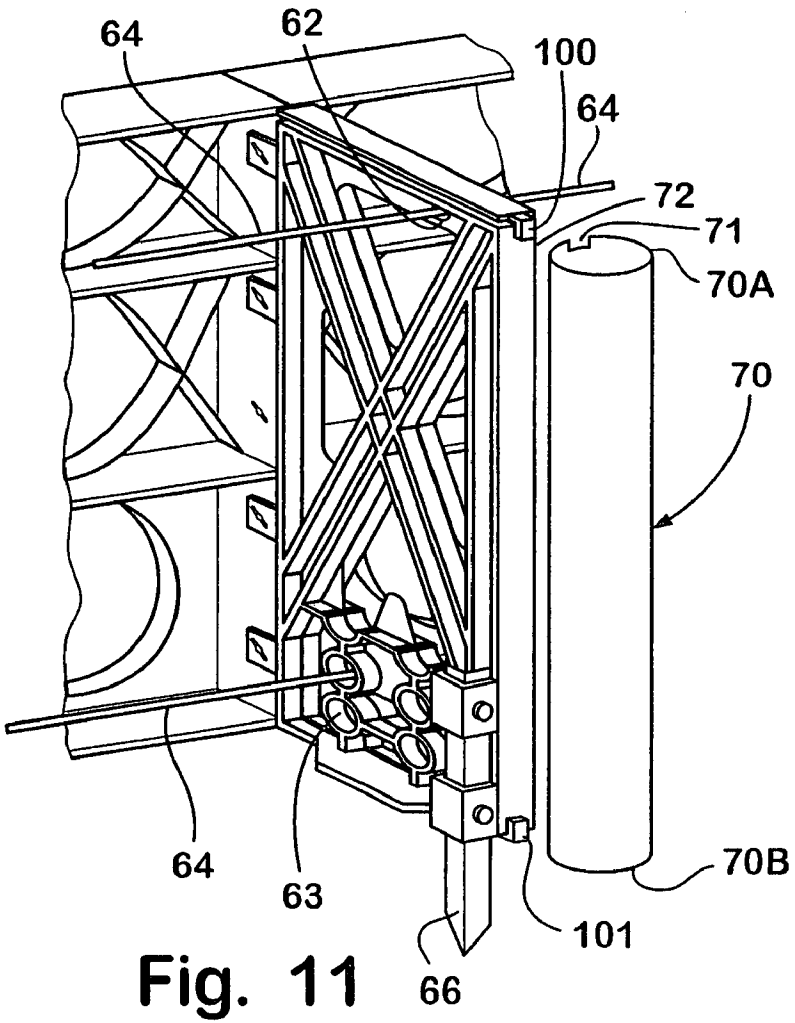
FIG. 11 is a partially fragmentary, exploded perspective view of a buttress and optional tube into which concrete can be poured to provide additional support.

With further reference to FIG. 11, a polymer (e.g., PVC) or cardboard tube 70 may be used to form a concrete pilaster to support the deck 8 and buttress 7. Tube 70 is first cut to the proper length, and a notch 71 is then cut into an upper edge 70A of tube 70. Buttress 7 includes a downwardly opening upper hook 100 (see also FIG. 8) and an upwardly opening lower hook 101. During assembly, upper end 70A of tube 70 is positioned adjacent outer surface 72 of buttress 7, and tube 70 is shifted upwardly such that hook 100 is positioned in notch 71. Lower end 70B of tube 70 is then rotated inwardly towards buttress 7, and tube 70 is then shifted downwardly until lower end 70B engages lower hook 101. Tube 70 is then rotated about its longitudinal axis to shift notch 71 away from upper hook 100, thereby attaching tube 70 to buttress 7. Concrete may then be poured into the tube 70 to form a pilaster that provides additional structural support for the deck 8.

Figure 12:
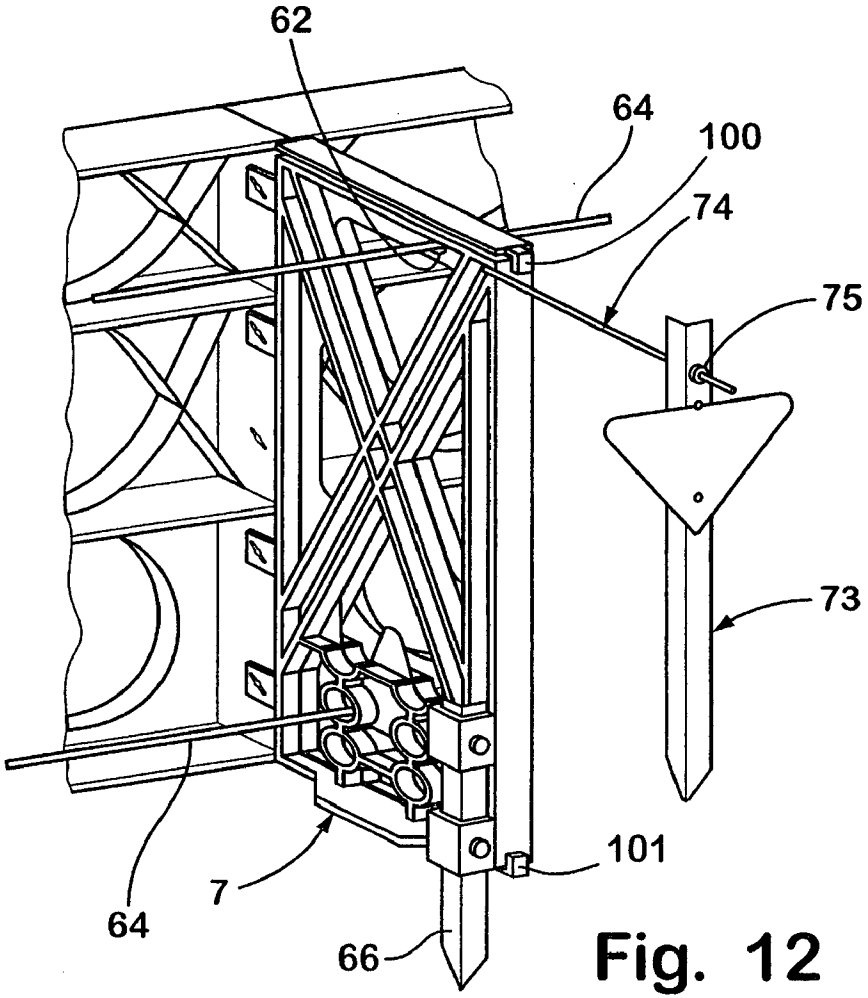
FIG. 12 is a fragmentary, perspective view of a buttress and anchor.
Figure 13:
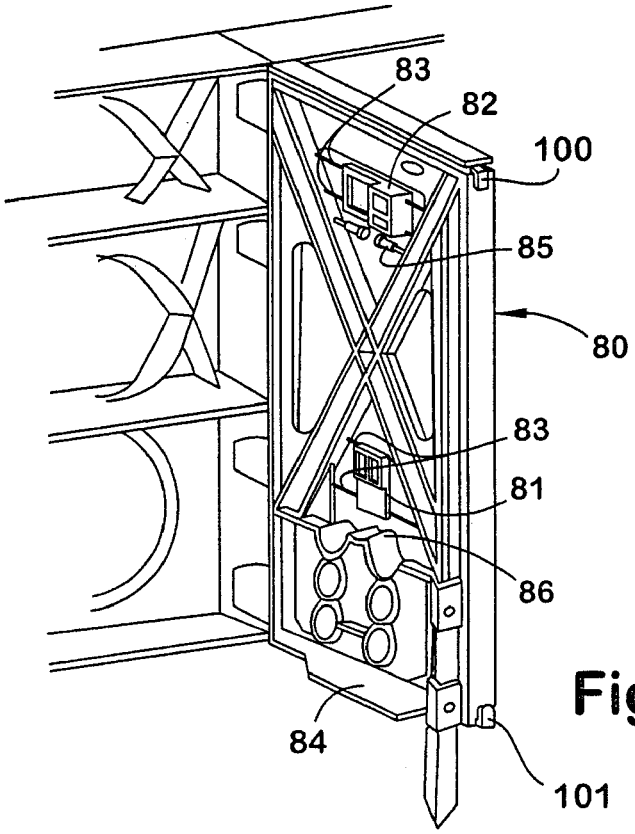
FIG. 13 is a perspective view of a portion of a pool and a buttress that includes leveling pads.

With further reference to FIG. 12, a "deadman anchor" 73 may be secured to the buttress 7 by an adjusting rod 74 and conventional hardware 75.

With further reference to FIG. 13, a buttress 80 may be molded to include a first leveling pad 81, and a second leveling pad 82. The leveling pads 81 and 82 are originally secured to the buttress 80 by a plurality of small runners 83 formed during the molding process. The leveling pads 81 and 82 may be removed from the buttress 80 by breaking the runners 83. As described in more detail below, the leveling pads 81 and 82 may be positioned under a lower flange 84 of buttress 80 to provide support during assembly of the pool 1. The buttress 80 may also include a known stake anchoring pin 85, and may include a third plumbing cradle 86.

Figure 14:
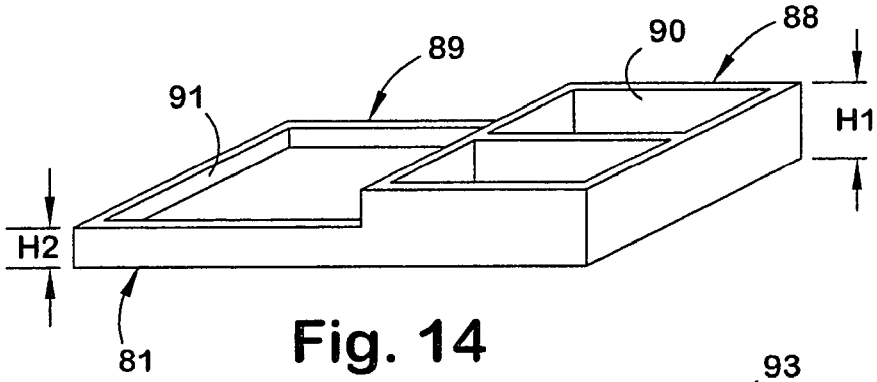
FIG. 14 is a perspective view of a first leveling pad having a first height.

With reference to FIG. 14, the first leveling pad 81 includes a first portion 88 having a height H1 that is about 0.50 inches, and a relatively thin portion 89 having a height H2 that is about 0.25 inches. Sidewalls 90 and 91 are relatively thin to reduce the amount of material needed to fabricate the leveling pad 81, and also to provide for quicker cooling, shorter molding cycle times, and reduced distortion during fabrication.

Figure 15:
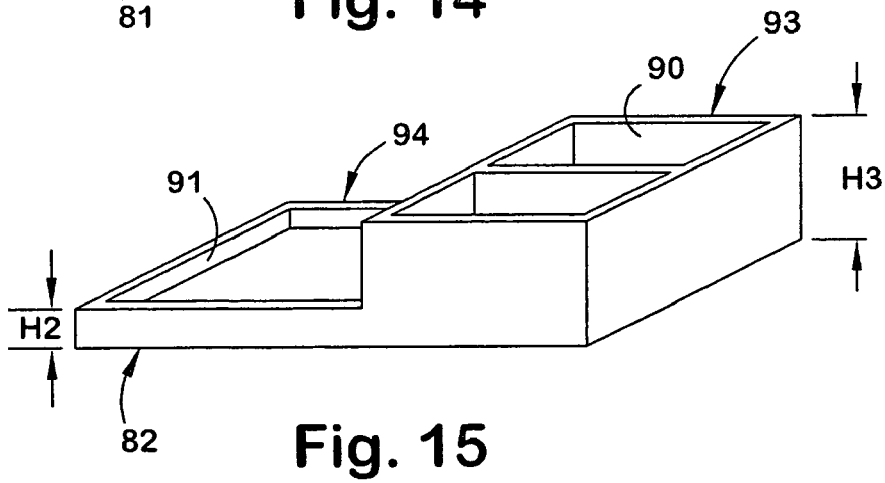
FIG. 15 is a perspective view of a second leveling pad having a second height that is greater than the height of the first leveling pad of FIG. 14.

With further reference to FIG. 15, the second leveling pad 82 includes a relatively large portion 93 having a height H3 that is about 0.75 inches, and a relatively thin portion 94 that has a height H2 of about 0.25 inches. The leveling pad 82 includes sidewall portions 90 and 91 that are relatively thin to facilitate fabrication in substantially the same manner as described above in connection with the leveling pad 81 of FIG. 14.

Figure 16A:
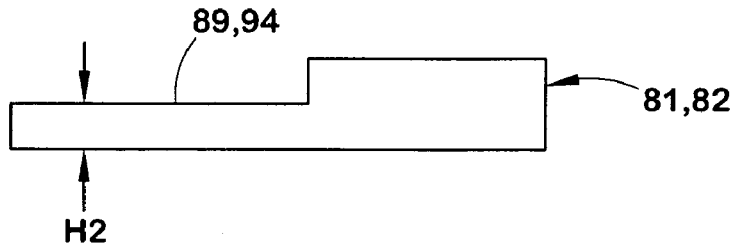
FIGS. 16A-16E are partially schematic views illustrating the different spacing heights that can be achieved utilizing the first and second leveling pads of FIGS. 14 and 15.
Figure 16B:
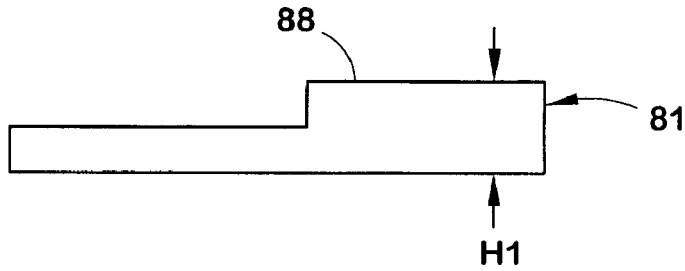
Figure 16C:
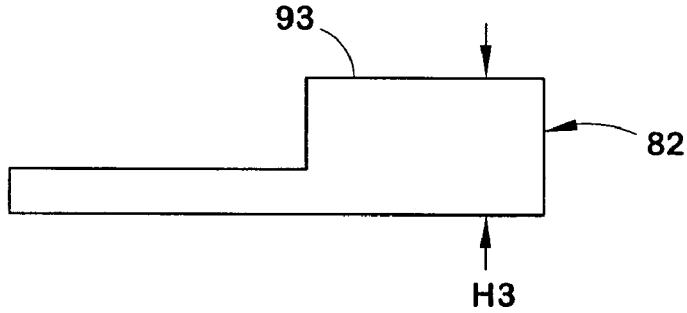
Figure 16D:
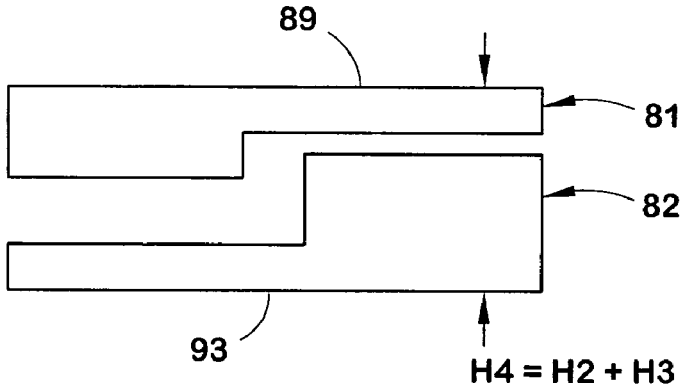
Figure 16E:
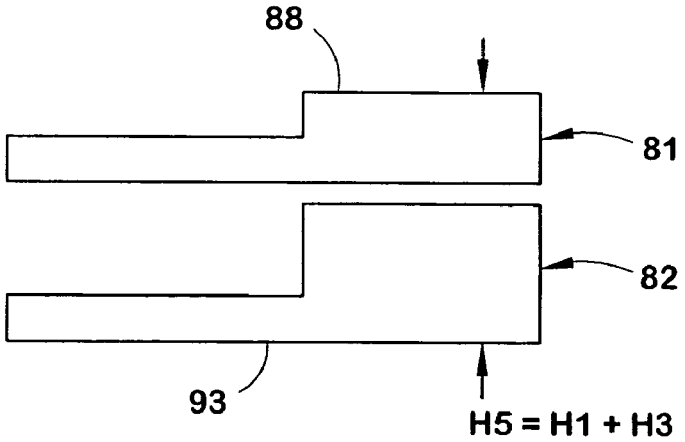

During assembly of the pool 1, the leveling pads 81 and 82 may be positioned under the lower flange 84 of buttress 80 to provide support. Various spacer heights can be achieved utilizing the leveling pads 81 and 82 as illustrated in FIGS. 16A-16E. With reference to FIG. 16A, a height of 0.25 inches can be achieved utilizing either the first leveling pad 81 or the second leveling pad 82 by positioning the thin portion 89 or 94 having a height H2 under the lower flange 84 of buttress 80. As illustrated in FIG. 16B, a spacer height of 0.50 inches can be achieved by positioning the larger portion 88 of leveling pad 81 having a height H1 (0.50 inches) under the flange 84 of buttress 80. With reference to FIG. 16C, a height of 0.75 inches can be achieved by positioning the thick portion 93 of the second leveling pad 82 having a height H3 (0.75 inches) under the flange 84 of buttress 80. A spacer height of 1.00 inches can be achieved by positioning the thin portion 89 of first leveling pad 81 on the thick portion 93 of leveling pad 82 to thereby provide a height H4 (1.00 inches) that is equal to H2 (0.25 inches) plus H3 (0.75 inches). Finally, a height H5 of 1.25 inches can be achieved by positioning the large portion 88 having a height of 0.50 inches of first leveling pad 81 on the large portion 93 having a height H3 (0.75 inches) of the second leveling pad 82 as illustrated in FIG. 16E.

The leveling pads 81 and 82 thereby provide a very quick and easy way to level the buttress 80 and pool 1 during fabrication. By utilizing the different heights and combinations of leveling pads illustrated above, a wide range of spacer heights can be achieved. It will be readily apparent that additional height combinations may be achieved utilizing additional leveling pads 81 and 82 from additional buttresses 80. Alternately, additional leveling pads could be separately supplied. Also, it will be readily apparent that the heights of the leveling pads may be different heights than the examples discussed about to provide proper spacing if required.

Figure 17:
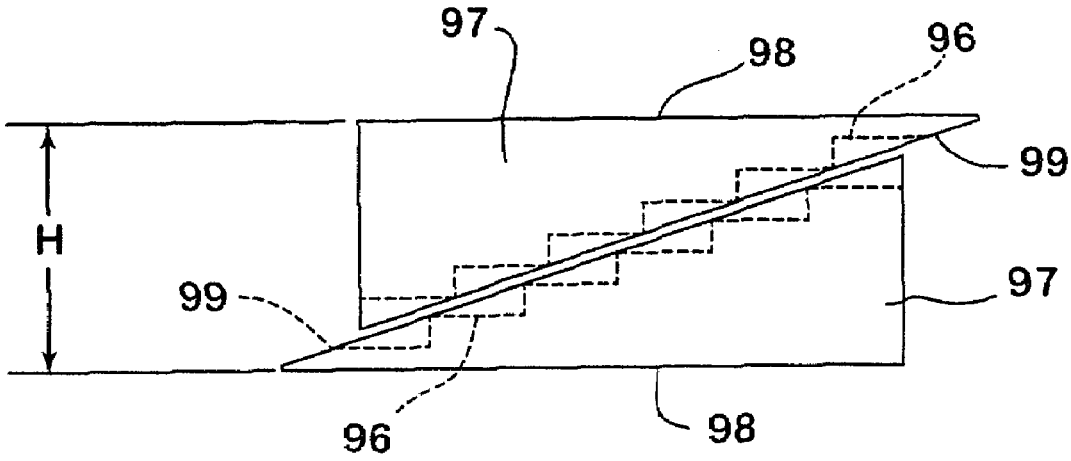
FIG. 17 is a partially schematic view illustrating another leveling pad arrangement.

With further reference to FIG. 17, a pair of wedge blocks 97 may also be utilized to provide for spacing below a buttress. Wedge blocks 97 include a flat surface 98 and an angled surface 99. In use, the angled surfaces 99 contact one another, such that the overall height H provided by the blocks 97 can be adjusted by horizontally shifting of the blocks 97 relative to one another. Also, the edges 99 may include a plurality of steps shown in dashed lines. The steps 96 on blocks 97 engage one another to provide adjustment for the height H without sliding of the blocks 97 relative to one another.

A pool according to the present invention may be quickly constructed, and also provides a very durable and secure structure. The buttresses, wall components, and peg and wedge connectors are constructed of a durable, non-corrosive material that also provides for a durable structure. The panels may have a wide variety of shapes, such as 90° inside and outside corners of relatively small or relatively large radiuses. Also, the panels may have a 135° configuration to provide for octagons "Lazy Grecians", "Lazy L's", or a wide variety of other configurations as required for a particular application.

What is claimed is:

1. A swimming pool, comprising:

a liner;

a plurality of panels interconnected to each other and forming a segmented wall for supporting an upper edge of the liner, each panel having a central portion defining a generally vertical plane in use, and including wall portions extending transverse relative to said plane, said wall portions of adjacent panels having at least one pair of elongated openings therethrough in registry with one another, and wherein the elongated openings define a major axis oriented at about forty-five degrees relative to the vertical plane;

connectors interconnecting adjacent panels, each connector having a peg member extending through a pair of said openings, said peg member having a wedge-receiving opening therethrough, said connectors including a wedge member extending through said wedge-receiving opening and tightly interconnecting adjacent panels.

2. The swimming pool of claim 1, wherein:

said peg members have body portion with an oblong cross sectional shape;

said openings through said wall portions having an oblong shape for receiving said body portions of said peg members.

3. The swimming pool of claim 2, wherein:

said openings through said wall portions define a first axis aligned with a first dimension and a second axis aligned with a second dimension orthogonal to said first dimension, said first dimension being greater than said second dimension, said first axis defining a non-zero angle relative to said plane defined by said central portions of said panels.

4. The swimming pool of claim 3, wherein:

said first axis defines an angle relative to said plane defined by said central portions of said panels that is approximately forty-five degrees.

5. A swimming pool, comprising:

a liner;

a plurality of panels interconnected to each other and forming a segmented wall for supporting an upper edge of the liner, each panel having a central portion defining a generally vertical plane in use, and including wall portions extending transverse relative to said plane, said wall portions of adjacent panels having at least one pair of openings therethrough in registry with one another, connectors interconnecting adjacent panels, each connector having a peg member extending through a pair of said openings, said peg member having a wedge-receiving opening therethrough, said connectors including a wedge member extending through said wedge-receiving opening and tightly interconnecting adjacent panels;

said peg members having body portions with an oblong cross sectional shape;

said openings through said wall portions having an oblong shape for receiving said body portions of said peg members, and wherein:

said openings through said wall portions have an enlarged central portion shaped to closely receive a threaded fastener having a circular cross-sectional shape.

6. A swimming pool, comprising:

a liner;

a plurality of panels interconnected to each other and forming a segmented wall for supporting an upper edge of the liner, each panel having a central portion defining a generally vertical plane in use, and including wall portions extending transverse relative to said plane, said wall portions of adjacent panels having at least one pair of openings therethrough in registry with one another, connectors interconnecting adjacent panels, each connector having a peg member extending through a pair of said openings, said peg member having a wedge-receiving opening therethrough, said connectors including a wedge member extending through said wedge-receiving opening and tightly interconnecting adjacent panels, wherein:

said wedge-receiving openings though said peg members comprise first wedge-receiving openings, said peg members having a second wedge-receiving opening therethrough.

7. The swimming pool of claim 6, wherein:

said first and second wedge-receiving openings are oblong, and have different sizes.

8. The swimming pool of claim 7, wherein:

said wedge members are generally flat and define side edges that taper towards one another.

9. The swimming pool of claim 8, wherein:

said peg members and said wedge members are made of a polycarbonate material.

10. A swimming pool, comprising:

a plurality of vertically enlarged panels interconnected to each other and forming a generally upright wall defining an inner side and an outer side, the wall adapted to support a pool liner on the inner side;

at least one buttress connected to the wall and extending transversely outward from the outer side thereof to support the wall, the buttress defining an outer edge that is horizontally spaced apart from the outer side of the wall and a horizontal upper edge, and wherein the buttress includes recesses on opposite sides of the buttress; and a deck support member having an outer end portion that extends outwardly away from the wall beyond the outer edge of the buttress to support a deck, wherein the deck support member is interconnected to the buttress in a manner that substantially prevents vertical movement of the outer end portion of the deck support member relative to the buttress, and wherein:

the deck support member comprises an elongated structural member attached to the upper edge of the buttress, and includes inwardly extending portions received in the recesses.

11. The swimming pool of claim 10, wherein:

the recesses comprise horizontally extending slots; and the inwardly extending portions of the deck support member comprise flanges.

12. The swimming pool of claim 11, wherein:

the deck support member has a C-shaped cross section.

13. The swimming pool of claim 10, including:

rebar extending transversely adjacent an upper portion of the buttress to support a deck.

14. The swimming pool of claim 13, including:

a concrete deck extending outwardly from the outer side of the wall, wherein the rebar is at least partially imbedded in the concrete deck.

15. The swimming pool of claim 10, including:

non-threaded quick connectors interconnecting the panels.

16. The swimming pool of claim 15, wherein:

the quick connectors comprise a peg and a wedge that engages the peg.

17. A swimming pool, comprising:

a generally upright wall structure defining an inner side and an outer side, wherein the wall structure configured to be positioned below ground;

at least one buttress structure extending outwardly from the upright wall structure, the buttress defining an upper portion, a lower portion, and an outer portion that is horizontally spaced apart from the upright wall structure, the outer portion of the buttress structure including a downwardly opening upper hook and an upwardly opening lower hook; and a tubular concrete form having an upper edge portion received in the upper hook, and a lower edge portion received in the lower hook to attach the tubular concrete form to the buttress structure.

18. The swimming pool of claim 17, wherein:

the tubular concrete form includes a notch in an edge at a selected one of the upper and lower portions.

19. The swimming pool of claim 18, wherein:

the concrete form has a cylindrical outer surface.

20. The swimming pool of claim 17, wherein:

the buttress structure is made of a polymer material;

the upper and lower hooks are integrally formed therewith.

* * * * *